US011280230B2

(12) United States Patent
Ahn et al.

(10) Patent No.: US 11,280,230 B2
(45) Date of Patent: Mar. 22, 2022

(54) ELECTRIC OIL PUMP SYSTEM INTEGRATED WITH HEAT EXCHANGER

(71) Applicants: HYUNDAI MOTOR COMPANY, Seoul (KR); KIA MOTORS CORPORATION, Seoul (KR)

(72) Inventors: Sung Hyun Ahn, Goyang-si (KR); Byoung Hoon Choi, Seongnam-si (KR); Seung Jae Kang, Seoul (KR); Hak Sung Lee, Hwaseong-si (KR); Yeon Ho Kim, Suwon-si (KR); Jong Hyun Kim, Yongin-si (KR); Tae Ho Kim, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 314 days.

(21) Appl. No.: 16/186,024

(22) Filed: Nov. 9, 2018

(65) Prior Publication Data

US 2019/0323391 A1 Oct. 24, 2019

(30) Foreign Application Priority Data

Apr. 18, 2018 (KR) ..... 10-2018-0044762

(51) Int. Cl.

| | |
|---|---|
| ***F01M 1/02*** | (2006.01) |
| ***F01M 5/00*** | (2006.01) |
| ***F01P 3/12*** | (2006.01) |

(52) U.S. Cl.
CPC ..... *F01M 1/02* (2013.01); *F01M 5/002* (2013.01); *F01P 3/12* (2013.01); *F01M 2001/0215* (2013.01)

(58) Field of Classification Search
None
See application file for complete search history.

(56) References Cited

U.S. PATENT DOCUMENTS

| | | | | |
|---|---|---|---|---|
| 5,217,085 A * | 6/1993 | Barrie | F01M 1/16 | 165/297 |
| 5,575,329 A * | 11/1996 | So | F28F 9/0217 | 165/167 |
| 6,267,094 B1 * | 7/2001 | Kuettner | F01M 1/02 | 123/196 A |
| 6,561,155 B1 * | 5/2003 | Williams | F01M 1/02 | 123/196 AB |
| 8,336,515 B2 * | 12/2012 | Jainek | F01M 11/0004 | 123/196 AB |

(Continued)

*Primary Examiner* — Peter J Bertheaud
*Assistant Examiner* — Geoffrey S Lee
(74) *Attorney, Agent, or Firm* — Lempia Summerfield Katz LLC

(57) ABSTRACT

An electric oil pump system integrated with a heat exchanger capable of reducing installation space and cost may include: an the electric oil pump including a motor and a pumping part operated by power of the motor to suck and send oil under pressurizing to an oil-used part; and a heat exchanger to exchange heat between the pressurized oil sent by the electric oil pump and coolant cooled at a radiator while the coolant and the pressurized oil pass through the heat exchanger. In particular, the heat exchanger is directly coupled to the electric oil pump and the oil-used part, respectively, and integrated with each other.

7 Claims, 2 Drawing Sheets

(56) References Cited

U.S. PATENT DOCUMENTS

| | | | | |
|---|---|---|---|---|
| 8,635,984 | B2 * | 1/2014 | Ardes | F01M 11/03 123/196 A |
| 8,696,326 | B2 * | 4/2014 | Hadar | F04B 17/03 417/363 |
| 9,054,565 | B2 * | 6/2015 | Fulton | H02K 9/19 |
| 2004/0045749 | A1 * | 3/2004 | Jaura | F16H 57/0413 180/65.26 |
| 2017/0175612 | A1 * | 6/2017 | Tokozakura | F01P 7/14 |

* cited by examiner

FIG. 1 "PRIOR ART"
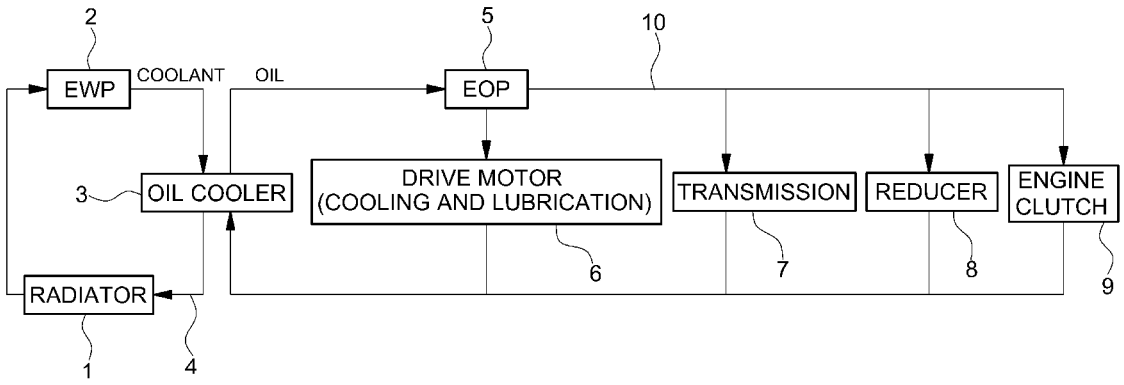
FIG. 2 "PRIOR ART"
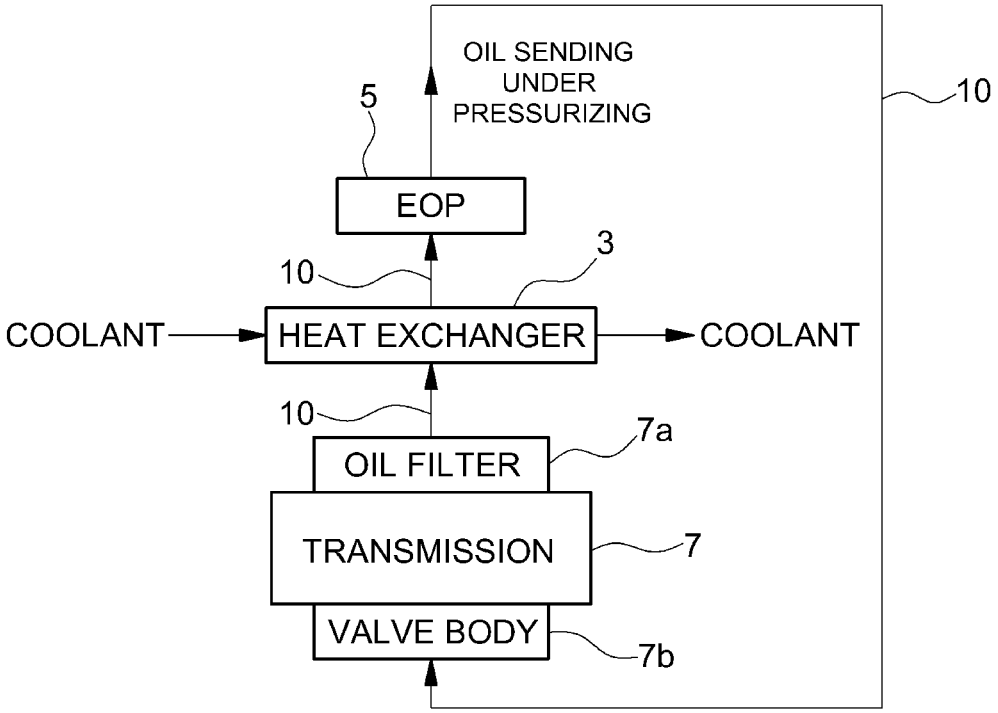

ELECTRIC OIL PUMP SYSTEM INTEGRATED WITH HEAT EXCHANGER

CROSS-REFERENCE TO RELATED APPLICATION

This application claims priority to and the benefit of Korean Patent Application No. 10-2018-0044762, filed on Apr. 18, 2018, the entire contents of which are incorporated herein by reference.

FIELD

The present disclosure relates to an oil pump system of a vehicle and more particularly, an electric oil pump system integrated with a heat exchanger capable of reducing installation space and cost.

BACKGROUND

The statements in this section merely provide background information related to the present disclosure and may not constitute prior art.

In general engine vehicles such as gasoline engine vehicles and diesel engine vehicles, a mechanical oil pumps (MOP), which are connected to the engine and driven by engine power, has been mainly used, whereas an the electric oil pump (EOP) has been used in eco-friendly vehicles where there is no engine or engine usage is limited.

For example, a hybrid vehicle is equipped with an oil pump that pressurizes and supplies the oil desired to drive engine clutches and transmissions, etc. Since an electric vehicle driving mode not using an engine, that is, an EV (Electric Vehicle) mode is provided at the hybrid vehicle, an mechanical oil pump (MOP) driven by engine power and an the electric oil pump (EOP) driven by a motor power are provided together.

Recently, in the hybrid vehicle, the mechanical oil pump has been eliminated or the capacity thereof has been reduced to improve the fuel efficiency and the use area and frequency of the electric oil pump has been increasing.

The electric oil pump in the vehicle has been driven by a separate motor irrespective of the engine that drives the vehicle, so there is an advantage of controlling the supply flow of the oil.

As like this, the electric oil pump has been applied to not only the hybrid electric vehicle (HEV) but also an eco-friendly vehicle that uses a motor as a vehicle drive source without engine, for example, a fuel cell electric vehicle (FCEV) that runs by driving a motor with electric power generated by a fuel cell or a pure electric vehicle (EV) that runs by driving a motor with the charging power of a battery.

In addition, in the vehicle using the electric oil pump (hereinafter, refer to as "EOP"), for example, in the hybrid vehicle, the EOP and an oil pump control unit (OPU), which is a kind of controller that drives and controls the EOP, are provided.

Generally, the EOP used in the vehicle is composed of a motor that receives the battery power through the OPU to be driven and controlled, and a pumping part that sucks and sends oil under pressurizing while the rotor thereof is rotated by the motor power.

In the EOP configuration, the rotating shaft of the motor and the rotor of the pumping part are mechanically connected to allow torque transmission, and the motor of the EOP is driven and controlled by the OPU.

On the other hand, the oil supplied by the EOP can be used as an operating fluid in an automatic transmissions or engine clutches, and can also be used for lubrication, cooling, and hydraulic pressure provision in vehicles.

For example, in an eco-friendly vehicle, a motor that is the vehicle driving source, i.e. a drive motor for driving the vehicle, can be cooled and lubricated by the oil supplied by the EOP, and lubrication can be achieved by the oil supplied by the EOP in a decelerator.

Recently, a technique has been known for injecting oil directly into a drive motor using an the electric oil pump to maximize the cooling of a motor mounted on an eco-friendly vehicle, for example, a drive motor and reduce the size of the drive motor.

At this time, a heat exchanger (oil cooler) can be used to cool the heated oil during the cooling of the motor, and the heat exchanger serves to cool the heated oil using a coolant.

FIG. 1 is a drawing illustrating a conventional apparatus configuration for cooling of a drive motor and oil.

As shown in FIG. 1, a radiator 1, which is a heat exchanger for releasing heat from the coolant, and an oil cooler 3, which is a heat exchanger for cooling the oil, are all provided. In the radiator 1, heat is released from the coolant by heat exchange between the coolant and air to achieve the cooling of the coolant.

The coolant and oil pass through the oil cooler 3 so that the cooling of the oil can be achieved by heat exchange between the coolant and the oil. At this time, the coolant passing through the oil cooler 3 is the coolant cooled by releasing heat during passing through the radiator 1.

That is, when a water pump (electric water pump, EWP) 2 is driven to suck and send oil under pressurizing, the sent coolant under pressurizing circulates along a coolant line 4 connecting the radiator 1 and the oil cooler 3. At this time, the coolant releasing heat at the radiator 1 passes through the oil cooler 3.

Further, the oil to be cooled, that is, the oil flowing along an oil line 10 after cooling the drive motor 6 passes through the oil cooler 3.

Therefore, the oil is cooled by the coolant while the heat exchange between the coolant and the oil is achieved at the oil cooler 3, and the cooled oil is again supplied to the drive motor 6 by the EOP 5 to be used to cool the drive motor.

The oil can be supplied to a transmission 7, a decelerator 8 and an engine clutch 9, and the like in addition to the drive motor 6, and the heat exchanger (oil cooler) 3 receives oil through the oil line 10 such as pipe from each part using oil, that is, the transmission 7, the decelerator 8, the engine clutch 9, and the like, and also, the heat exchanger 3 receives the coolant through the coolant line 4 such as pipe, and the like.

FIG. 2 is a drawing showing an electric oil pump and a heat exchanger for oil cooling according to a conventional art.

As shown in FIG. 2, the EOP 5 is configured to suck and send oil under pressurizing. When the EOP 5 is driven to suck oil, the suction force is applied to the oil flow path in a heat exchanger (i.e., oil cooler) 3 through an inlet port of the EOP 5. Therefore, the oil is sucked through the inlet port of the EOP 5 from transmission 7, which is the oil-used-part, through the oil flow path in the heat exchanger 3.

The oil sucked from the oil-used-part 7 passes through the oil flow path in the heat exchanger 3 and then to be sucked through the inlet port of the EOP 5. At this time, a separate flow path through which coolant can pass, that is, a coolant flow path is provided in the heat exchanger 3, so that heat exchange between coolant passing through the coolant flow path and oil passing through the oil flow path is achieved in heat exchanger 3 to cool oil.

In the configuration shown in FIG. 2, the heat exchanger 3 is used to cool oil using coolant, which can be conventional oil cooler where heat exchange between cold coolant and hot oil is performed.

In this configuration, the EOP 5, the heat exchanger 3 and the oil-used-part 7 are connected with each other through a separate oil line 10 such as a pipe, a tube, a hose or a duct, and the like, even if closely disposed in a limited vehicle space.

That is, the inlet port of the EOP 5 and the oil outlet port of the heat exchanger 3 are connected with each other through the oil line 10 such as a pipe, a hose, a tube or a duct, and the like, and the oil inlet port of the heat exchanger 3 and the oil outlet port of the oil-used-part 7 are connected with each other through the oil line 10 such as a pipe, a hose, a tube or a duct, and the like.

In this configuration according to the conventional art, when the EOP 5 sucks oil through the inlet port thereof, the exhausted oil from the oil-used-part 7 enters the inlet port of the EOP 5 via the oil flow path in the heat exchanger 3.

We have discovered that if the heat exchanger has a long oil flow path between the inlet port of EOP 5 and the outlet port of oil-used-part 7, there is a high risk of cavitation at the inlet port of the EOP 5.

Furthermore, as described above, in accordance with the conventional art, the heat exchanger 3 for cooling the oil and each of components 7 are long connected with each other by the oil line 10 such as a pipe, a hose, a tube or a duct, and the like.

Therefore, in the conventional art, we have discovered that additional package space is desired for piping as well as cost increases.

The above information disclosed in this Background section is only for enhancement of understanding of the background of the present disclosure and therefore it may contain information that does not form the prior art that is already known to a person of ordinary skill in the art.

SUMMARY

The present disclosure provides an the electric oil pump system integrated with a heat exchanger capable of reducing installation space and cost by including a module configuration that directly connects and integrates an the electric oil pump, a heat exchanger for cooling oil and oil-used parts to each other to form one body in a vehicle equipped with an the electric oil pump (EOP).

In one form of the present disclosure, an electric oil pump system integrated with a heat exchanger may include: an electric oil pump including a motor and a pumping part operated by the power of the motor and configured to suck and send oil under pressurizing to an oil-used part; and a heat exchanger configured to exchange heat between the pressurized oil sent by the electric oil pump and coolant cooled at a radiator while the coolant and the pressurized oil pass through the heat exchanger In particular, the heat exchanger is joined to and directly coupled to the electric oil pump and the oil-used part, respectively, and integrated with each other.

In one form, the pumping part includes a discharging port configured to discharge the pressurized oil from the electric oil pump and may be directly coupled to an oil inlet port of an oil flow path in the heat exchanger; and an oil outlet port of the oil flow path in the heat exchanger may be directly coupled to an oil inlet port of the oil-used part.

Further, a direct pipe line may penetrate the heat exchanger, and the pumping part may include an oil inlet port configured to suck the oil into the electric oil pump and connected to an oil outlet port of the oil-used part by the direct pipe line, so that the oil flows from the oil-used part to the electric oil pump through the direct pipe line.

In another form, a coolant line for circulating coolant may be connected between the radiator, a water pump and the heat exchanger; and the water pump sucks and sends the coolant under pressurizing to circulate the coolant along the coolant line.

In addition, the motor of the electric oil pump may be provided with a first oil flow path through which the oil passes; and a part of the pressurized oil sent from the pumping part is configured to cool the motor while passing through a second oil flow path formed on a side of the motor.

The pumping part of the electric oil pump may include: an inlet port configured to suck the oil, discharging port configured to discharge the pressurized oil; and a first oil flow path configured to connect the inlet port and the discharging port and to guide the oil to the discharging port. In another form, a second oil flow path formed in the motor is branched out from the first oil flow path and configured to circulate a part of the pressurized oil inside of the motor while remaining oil of the pressurized oil flows in the heat exchanger through the first oil flow path.

The oil flow path of the motor side may be connected with the inlet port in the pumping part of the electric oil pump to be connected with the inlet port side flow path in which the oil sucked in the inlet port flows.

Therefore, in the electric oil pump system according to the present disclosure, the electric oil pump (EOP) is integrated with the heat exchanger for cooling the oil to form one body, so that it is possible to reduce the volume and the occupied space in a vehicle and it is more advantageous than the conventional one in terms of the package of the electric oil pump and the heat exchanger.

In addition, it is possible to remove components such as pipes, hoses, tubes, ducts, etc., for connecting between the electric oil pump, the heat exchanger and oil-used-part, and to eliminate the assembly process thereof, thereby reducing cost.

Furthermore, the improvement and reduction of the oil flow paths makes it possible to reduce the amount of oil, improve the oil circulation efficiency and the electric oil pump efficiency by reducing the pipe resistance, and reduce the motor capacity due to the cooling of the electric oil pump, thereby reducing the volume and the cost.

Other aspects and exemplary forms of the present disclosure are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 is a drawing illustrating a conventional apparatus configuration for cooling of a drive motor and oil;

FIG. 2 is a drawing showing an the electric oil pump and a heat exchanger for oil cooling according to a conventional art;

Figure 3:
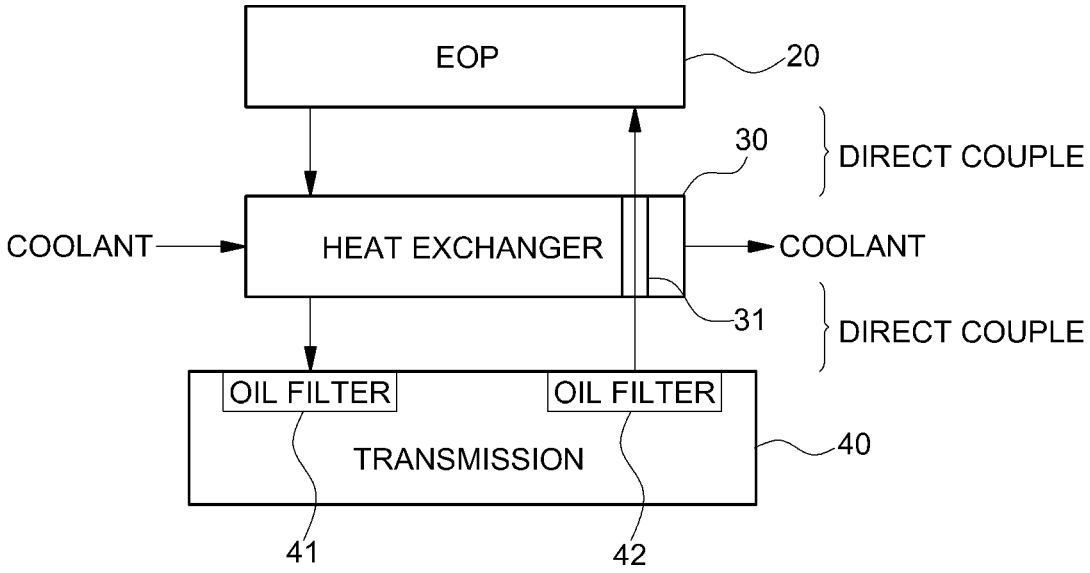
FIG. 3 is a schematic drawing of the configuration of an the electric oil pump system with a heat exchanger according to an exemplary form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

It should be understood that the appended drawings are not necessarily to scale, presenting a somewhat simplified representation of various features illustrative of the basic principles of the present disclosure. The specific design features of the present disclosure as disclosed herein, including, for example, specific dimensions, orientations, locations, and shapes will be determined in part by the particular intended application and use environment.

Hereinafter, reference will now be made in detail to various forms of the present disclosure, examples of which are illustrated in the accompanying drawings and described below. While the present disclosure will be described in conjunction with exemplary forms, it will be understood that present description is not intended to limit the present disclosure to those exemplary forms. On the contrary, the present disclosure is intended to cover not only the exemplary forms, but also various alternatives, modifications, equivalents and other forms, which may be included within the spirit and scope of the present disclosure as defined by the appended claims.

In the whole description, it will be understood that when a component is referred to as being "comprising" any component, it does not exclude other components, but can further comprises the other components unless otherwise specified.

Figure 4:
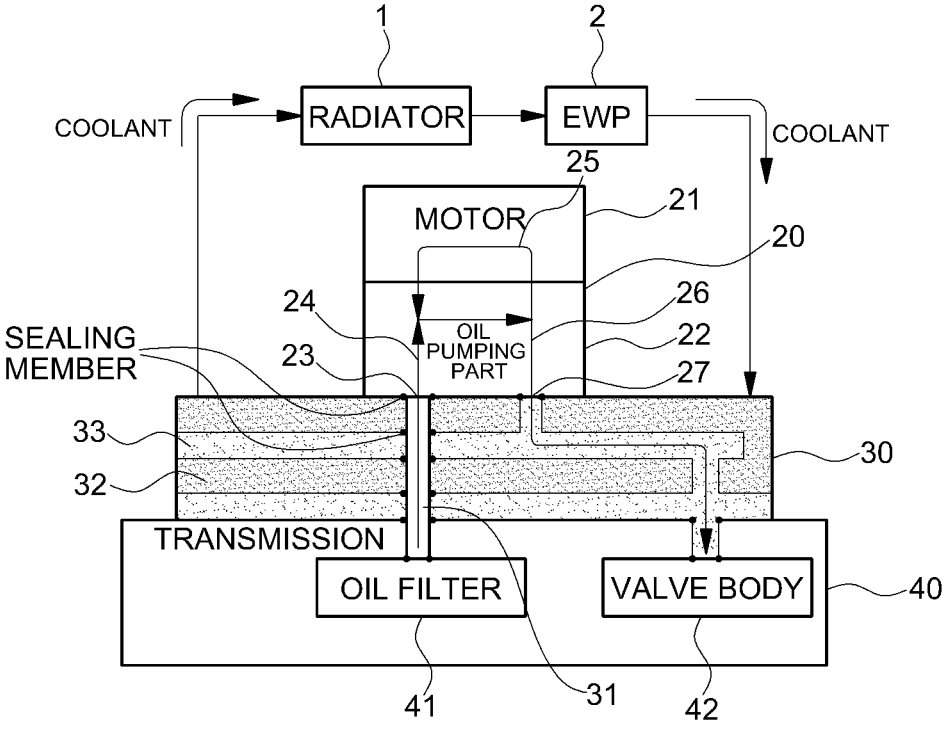
FIG. 4 is a drawing illustrating further details of the electric oil pump system integrated with the heat exchanger according to an exemplary form of the present disclosure.

FIG. 3 is a schematic drawing of the configuration of an the electric oil pump system with a heat exchanger according to an exemplary form of the present disclosure; and FIG. 4 is a drawing illustrating further details of the electric oil pump system integrated with the heat exchanger according to an exemplary form of the present disclosure.

The present disclosure is to provide an the electric oil pump system integrated with a heat exchanger capable of reducing installation space and cost by including a module configuration that directly connects and integrates an the electric oil pump 20, a heat exchanger 30 for cooling oil and an oil-used part 40 to each other to form one body in a vehicle equipped with an the electric oil pump (EOP) 20.

The vehicle equipped with the electric oil pump system of the present disclosure can be an eco-friendly vehicle such as a hybrid vehicle, a fuel cell vehicle, or a pure electric vehicle as well as a vehicle using a conventional the electric oil pump.

As shown in FIG. 4, the electric oil pump system of the present disclosure may have the integrated module configuration that the electric oil pump 20, the heat exchanger 30, and the oil-used part 40 are integrally directly connected together. In this case, the heat exchanger 30 for cooling the oil may be disposed between the electric oil pump 20 and the oil-used part 40 to be integrated.

The electric oil pump 20 in the present disclosure may be driven by a motor 21. The electric oil pump 20 may include the motor 21, which receives a battery power through an oil pump control unit (OPU) not shown to be driven and controlled, a pumping part 22 of which a rotor is rotated by the power of the motor 21 to suck and send oil under pressurizing.

In the electric oil pump 20, the rotation shaft of the motor 21 and the rotor of the pumping part 22 may be mechanically connected to each other with a torque transmission mechanism.

In this the electric oil pump 20, when the motor 21 is driven and controlled by an oil pump control unit (OPU), the pumping part 22, which is rotated by the power of the motor 21, sucks and sends the oil of the regulated flow rate under pressurizing.

In the present disclosure, the oil supplied by the electric oil pump may be used as an operating oil in the automatic transmission as mentioned above, or may be used as an operating oil in an engine clutch or the like, or may be used for lubrication, cooling and hydraulic pressure supply in a vehicle.

For example, in the case of the motor as a vehicle driving source, that is, a drive motor for driving a vehicle, the drive motor may be cooled and lubricated by the oil supplied by the electric oil pump of the present disclosure and a decelerator may be lubricated by the oil supplied by the electric oil pump of the present disclosure.

As the electric oil pump in the present disclosure, the electric oil pump of which the rotating shaft of the motor and the rotor of the pumping part are connected to each other with a torque transmission mechanism so that the pumping can suck and send oil under pressurizing when the rotor is rotated by the torque of the motor, can be applied and any one of conventional electric oil pumps can be adopted.

For example, it is possible to apply an internal gear type oil pump which is a type of electric oil pump widely used in a hybrid vehicle.

As is known, in an internal gear type oil pump, which is one type of rotary gear pump, the pump consists of two rotors having a tooth shape, namely an inner rotor and an outer rotor and the inner rotor is connected with the rotating shaft of the motor to be able to transmit torque.

In addition, in the present disclosure, the electric oil pump may be in the form of a vane pump with a pumping part of which a vane is installed at the rotor, or an external gear type pump with a pumping part of which a drive gear is installed in the rotor and a driven gear is engaged with the drive gear.

Further, in the electric oil pump system of the present disclosure, the electric oil pump 20 may be directly connected with the heat exchanger 30, and the heat exchanger 30 may be directly connected with the oil-used part 40.

Herein, the heat exchanger 30 may have a coolant flow path 32 through which the coolant passes and an oil flow path 33 through which the oil passes therein, so that the coolant and oil pass through the respective flow paths 32 and 33 provided in the heat exchanger 30. As a result, the heat exchanger 30 allows heat exchange between the coolant and oil.

At this time, the coolant cooled by heat exchange with air while passing through a radiator 1 is sent under pressurizing by a water pump (EWP) 2 to pass through the coolant flow path 32 in the heat exchanger 30, whereas in the case of the oil, the oil exhausted and sent under pressuring by the electric oil pump 20 (hereinafter, referred to as "EOP") passes through the oil flow path 33 in the heat exchanger 30, so that heat exchange between the coolant passing through the coolant flow path 32 and the oil passing through the oil flow path 33 can be achieved in the heat exchanger 30.

In the heat exchanger 30, heat exchange is carried out in which the heat is transferred from relatively high temperature oil to a relatively low temperature coolant, thereby cooling the oil by the coolant.

The oil cooled by the coolant and lowered in temperature is supplied to the oil-used part 40, and conversely, the oil circulated through the oil-used part 40 passes through a separate direct pipeline 31 installed to penetrate the heat exchanger 30 instead of the oil flow path inside the heat exchanger 30 and is sucked into the EOP 20 directly without heat exchange.

As shown in FIGS. 3 and 4, the heat exchanger 30 can be a stacked type heat exchanger 30 with alternating the oil flow path 33 and the coolant flow path 32 to be stacked, and the detailed flow path structure of the stacked type heat exchanger 30 is known in various ways, so the detailed description thereof will be omitted in this specification.

Referring to FIG. 4, in the EOP 20, the pumping part 22, which sucks and sends oil under pressurizing, may be integrally coupled with the heat exchanger 30 for oil cooling with directly contacted state, and the heat exchanger 30 may be integrally coupled with the oil-used part 40 with directly contacted state.

That is, in an exemplary form shown in FIG. 4, the upper surface of the pumping part 22 of the EOP 20 and the upper surface of the heat exchanger 30 are integrally joined together to be integrally coupled with each other and a discharging port 27 provided in the pumping part 22 of the EOP 20 may be directly connected to the oil inlet port of the oil flow path 33 of the heat exchanger 30.

The bottom surface of the heat exchanger 30 may be joined to and integrally coupled with the engage side of the oil-used part 40, and the oil outlet port of the oil flow path 33 of the heat exchanger 30 may be directly connected to the oil inlet port of the oil-used part 40.

Referring to FIG. 4, the coolant flow path 32 through which the coolant passes and the oil flow path 33 through which the oil flows are alternately stacked in the heat exchanger 30, but the structure and form of the coolant flow path and the oil flow path are illustrative, and the present disclosure does not limit by the exemplary form of the present disclosure.

As the heat exchanger 30 of the electric oil pump system according to the present disclosure, one of the known heat exchanger types in which a coolant flow path and an oil flow path are provided inside and heat exchange can be performed between the coolant and the oil passing through the two flow paths, may be adopted and applied.

As the flow path structure, for example, if one flow path is inserted into another flow path (e.g., the oil flow path is inserted into the coolant flow path), or if one of the coolant and oil passes through the core, it may be configured to allow the rest of the fluid to pass around the fins outside the core in the heat exchanger.

Herein, the shape of the core may be not particularly limited to a square or a circle, and the like.

In the electric oil pump system of the present disclosure, the heat exchanger 30 may be the oil cooler for cooling the oil used for cooling the drive motor, and a known stacked type oil cooler may be used as the oil cooler.

Various types of the stacked type oil coolers are known, so detailed descriptions will be omitted in this specification.

Further, the radiator 1 is a component for releasing the heat of the coolant. A coolant line 4 for the coolant circulation may be connected between the radiator 1, the water pump 2 and the heat exchanger 30, and the water pump 2 sucks and send the coolant under pressurizing to circulate along the coolant line 4.

The water pump 2 can be an electric water pump (EWP), and when the water pump 2 is driven to suck and send the coolant under pressurizing, the coolant circulates along the coolant line 4 between the heat exchanger 30 and the radiator 1.

Also, in the present disclosure, the oil-used part 40 can be a transmission (Auto transmission, AT) 40, and if the EOP 20 is driven, the EOP 20 will suck the oil from the transmission 40 through an oil filter 41, the oil is sent under pressuring to the valve body 42 so that the sent oil under pressurizing can be supplied to each element of the transmission 40 through the valve body 42.

For this, in the electric oil pump system, which has an integrated module configuration with an integrated EOP 20 and an oil-used part (e.g., transmission) interposed with the heat exchanger 30, the heat exchanger 30 may include a direct pipe line 31 connecting the suction port 23 provided in the pumping part 22 and the oil outlet port of the oil-used part 40 may be installed.

In the exemplary form, the direct pipe line 31 may be installed to penetrate the inside of the heat exchanger 30. One end of the direct pipe line 31 may be connected to the suction port 23 of the EOP 20 and the other end of the direct pipe line 31 may be connected to the oil outlet port of the oil-used part 40, for example, the oil outlet port of the oil filter 41 installed inside or on one side in the transmission 40.

Thus, by connecting the direct pipe line 31 to the suction port 23 of the EOP 20, the oil sucked through the suction port 23 of the EOP 20 does not pass through the oil flow path 33 in the heat exchanger 30 but is directly sucked to the oil-used part 40 through the direct pipe line 31. In this case, it is possible to reduce the occurrence of cavitation during suction of the EOP 20 and increase the life of the pump.

If the EOP 20 is driven and the oil sucked from the oil-used part 40 by the suction force passes through the oil flow path 33 in the heat exchanger 30 and enters the inlet port 23 of the EOP 20, the oil pressure loss at the oil flow path 33 in the heat exchanger 30 causes cavitation at suction of EOP 20, which can significantly shorten pump life.

Therefore, in the present disclosure, oil can flow along the oil flow path of "the oil-used part 40 (the oil filter 41)→the direct pipe line 31→the inlet port 23 of the EOP 20→the pumping part 22→the discharge port 27 of the EOP 20→the oil flow path 33 in the heat exchanger 30→the oil-used part 40".

As like this, in the present disclosure, in order that oil is sucked from the oil-used part 40 to the inlet port 23 of the EOP 20, a direct pipe line 31 penetrating the coolant flow path 32 and the oil flow path 33 is inserted into the heat exchanger 30 instead of connecting the oil-used part 40 to the inlet port 23 of the EOP 20 through a separate external pipe, a hose, a tube, a pipe, a duct and the like, so that the inlet port 23 of the EOP 30 is directly connected to the oil-used part 40 (the oil filter 41) through the direct pipe line 31. As a result, the oil suction of the EOP 20 is made directly from the oil-used part 40 via the direct pipe line 31.

In one form, a sealing member for preventing oil leakage may be interposed between the inlet port 23 of the EOP 20 and one end of the direct pipe line 31 to prevent leakage of oil, and likewise, a sealing member for preventing oil and water leakage may be interposed between the other end of the direct pipe line 31 and the oil outlet port of the oil filter 41, or between the direct pipe line 31 and the coolant flow path 32 and the oil flow path 33 in the heat exchanger 30, and the like to prevent oil leakage and coolant leakage.

Also, a sealing member may be interposed between the discharging outlet 27 of the EOP 20 and the inlet port of the oil flow path 33 in the heat exchanger 30 to prevent oil leakage, and a sealing member may be interposed between the outlet port of the oil flow path 33 in the heat exchanger 30 and the oil inlet port of the oil-used part 40 (the transmission 40 to valve body 42) to prevent oil leakage.

In the present disclosure, the sealing member may be a gasket or O-ring, and the like of rubber material.

Then, FIG. 3 and FIG. 4 shows an example of oil-used part 40 being transmission 40, but the oil-used part 40 may be a drive motor as described above. The oil is used for cooling and lubrication in the drive motor, and then sucked by the EOP 20.

Also, as an exemplary form of the present disclosure, the oil flow path may be configured so that the oil sent under pressurizing in the pumping part 22 of the EOP 20 passes through oil flow path 25 in the motor side of the EOP 20 and then to be sucked into the pumping part 22 of the EOP 20.

That is, a part of the oil sent under pressurizing from the pumping part 22 of the EOP 20 to flow the discharge port 27 is divided to flow the oil flow path 25 of the motor side of the EOP 20, so that the cooling of the motor is achieved by the oil sent under pressurizing to and flowing through the oil flow path 25 of the motor side.

When the EOP 20 is driven, heat is released from the coil 21, and the like of the motor 21, which desires cooling the parts of the motor 21 such as the coil.

Therefore, in the present disclosure, some of the sent oil under pressuring from the pumping part 22 of EOP 20 flows to the oil flow path 25 of the motor side, causing the motor 21 of the EOP 20 to cool and the remaining oil to be sent to the heat exchanger 30.

At this time, the oil flow path 25 of the motor side is branched in an outlet port side flow path 26 provided so that the sent oil under pressurizing toward the discharging port 27 from the pumping part 22 of the EOP 20 can flow, and the oil flow path 25 of the motor side may be a flow path formed in the motor side housing, and the like through which the oil can pass to flow.

The oil flow path 25 of the motor side can also be branched into a plurality of oil flow paths located outside to enclose the non-illustrated rotor and stator in the motor side housing, and the oil passing through this branched oil flow path can flow to an inlet port side flow path 24 in the pumping part 22 through the combined flow path later.

To this end, the oil flow path 25 of the motor side (i.e., the combined flow path) may be connected to the inlet port side flow path 24 in the pumping part 22, where the inlet port side flow path 24 may be a flow path through which the oil sucked through the inlet pot 23 in the pumping part 22 can pass.

Since the suction force during operation of the pumping part 22 also acts on the oil flow path 25 of the motor side through the inlet port side flow path 24, the oil passing through the oil flow path 33 of the motor side is combined with the oil sucked through the direct pipe line 31 and then sent under pressurizing again by the pumping part 22.

In addition, the motor 21 of the EOP 20 and the OPU can be integrated together, in the case that the OPU contacted with the motor 21 can be cooled together during cooling the motor 21 of the EOP 20.

Thus, in the electric oil pump system according to the present disclosure, the EOP 20 is integrated with the heat exchanger 30 for oil cooling, thereby reducing the volume and reducing the occupied space in the vehicle, and also, there is an advantage in that the package side of the EOP 20 and the heat exchanger 30 is advantageous compared with the conventional one.

In addition, it is possible to delete parts for connecting between the EOP 20, the heat exchanger 30 and the oil-used part 40 such as a pipe, a hose, a tube, a duct, and the like and assembly process thereof, thereby reducing cost.

Furthermore, by improving and reducing the oil path, it is possible to reduce the amount of oil, improve the oil circulation efficiency and EOP 20 efficiency by reducing the duct resistance, and reduce the EOP motor capacity by cooling EOP 20, so that the volume reduction and the cost reduction effect can be expected.

Although the present disclosure has been described with reference to an exemplary form, it is to be understood that a person skilled in the art may modify and change the elements of the present disclosure within the range of the present disclosure.

In addition, many changes can be made to specific situations or materials within a range that does not deviate from the present disclosure.

The present disclosure, therefore, is not to be limited to the detailed description of the forms of the present disclosure, but will include all forms within the scope of the present disclosure.

What is claimed is:

1. An electric oil pump system integrated with a heat exchanger, the electric oil pump system comprising:

an electric oil pump including a motor and a pumping part operated by power of the motor and configured to suck and send oil under pressure to an oil-used part;

a heat exchanger including a coolant flow path through which a coolant flows and an oil flow path through which the pressurized oil flows, and configured to exchange heat between the pressurized oil sent by the electric oil pump and coolant cooled at a radiator while the coolant and the pressurized oil pass through the coolant flow path and the oil flow path of the heat exchanger, wherein the heat exchanger is directly coupled to the electric oil pump and the oil-used part, respectively, and integrated with each other;

a straight pipe line configured to pass through the heat exchanger by straightly piercing the coolant flow path and the oil flow path inside the heat exchanger and configured to guide the oil directly from the oil-used part to the electric oil pump; and a plurality of sealing members interposed between the straight pipe line, the coolant flow path and the oil flow path.

2. The electric oil pump system of claim 1, wherein:

the pumping part includes a discharging port configured to discharge the pressurized oil from the electric oil pump and configured to directly couple to an oil inlet port of the oil flow path in the heat exchanger; and an oil outlet port of the oil flow path in the heat exchanger is directly coupled to an oil inlet port of the oil-used part.

3. The electric oil pump system of claim 1, wherein, the straight pipe line includes: a first end in communication with an oil outlet port of the oil-used part, and a second end in communication with an inlet port of the pumping part and configured to suck the oil into the electric oil pump, so that the oil directly flows from the oil-used part to the electric oil pump through the straight pipe line.

4. The electric oil pump system of claim 1, wherein:

a coolant line configured to circulate coolant is connected between the radiator, a water pump and the heat exchanger; and the water pump configured to suck and send the coolant under pressure and to circulate the coolant along the coolant line.

5. The electric oil pump system of claim 1, wherein:

the motor of the electric oil pump is provided with a first oil flow path through which the oil passes; and a part of the pressurized oil sent from the pumping part is configured to cool the motor while passing through a second oil flow path formed on a side of the motor.

6. The electric oil pump system of claim 1, wherein the pumping part of the electric oil pump comprises:

an inlet port configured to suck the oil;

a discharging port configured to discharge the pressurized oil; and a first oil flow path configured to connect the inlet port and the discharging port and to guide the oil to the discharging port.

7. The electric oil pump system of claim 6, wherein a second oil flow path formed in the motor is branched out from the first oil flow path and configured to circulate a part of the pressurized oil inside of the motor while remaining oil of the pressurized oil flows in the heat exchanger through the first oil flow path.

* * * * *